US006828693B2

(12) United States Patent
von Staudt et al.

(10) Patent No.: US 6,828,693 B2
(45) Date of Patent: Dec. 7, 2004

(54) ELECTRIC CIRCUIT

(75) Inventors: Hans Martin von Staudt, Weilheim/Teck (DE); Christoph Oster, Lüdenscheid (DE)

(73) Assignee: Leopold Kostal GmbH & Co. KG, Ludenscheid (DE)

( * ) Notice: Subject to any disclaimer, the term of this patent is extended or adjusted under 35 U.S.C. 154(b) by 234 days.

(21) Appl. No.: 10/068,118

(22) Filed: Feb. 5, 2002

(65) Prior Publication Data

US 2002/0074858 A1 Jun. 20, 2002

Related U.S. Application Data

(63) Continuation of application No. PCT/EP00/07649, filed on Aug. 8, 2000.

(30) Foreign Application Priority Data

Aug. 10, 1999 (DE) ..... 199 37 682

(51) Int. Cl.[7] ..... G05F 3/04
(52) U.S. Cl. ..... 307/10.1; 700/12; 714/797
(58) Field of Search ..... 307/10.1; 700/12; 192/240; 714/820, 797

(56) References Cited

U.S. PATENT DOCUMENTS

| | | | | |
|---|---|---|---|---|
| 4,388,704 A | | 6/1983 | Bertin et al. | |
| 4,719,993 A | * | 1/1988 | Ujihara | 187/247 |
| 4,811,293 A | * | 3/1989 | Knothe et al. | 365/195 |
| 5,003,192 A | * | 3/1991 | Beigel | 307/140 |
| 5,138,186 A | * | 8/1992 | Dumbovic | 327/91 |
| 5,341,080 A | * | 8/1994 | Agut Sanz | 318/778 |
| 5,731,763 A | * | 3/1998 | Herweck et al. | 340/825.69 |
| 5,751,532 A | * | 5/1998 | Kanuchok et al. | 361/94 |
| 6,066,228 A | * | 5/2000 | Brunson et al. | 156/294 |
| 6,066,931 A | * | 5/2000 | Morris et al. | 318/445 |
| 6,151,529 A | * | 11/2000 | Batko | 700/28 |
| 6,215,689 B1 | * | 4/2001 | Chhor et al. | 365/63 |
| 6,275,949 B1 | * | 8/2001 | Watanabe | 713/324 |
| 6,600,960 B1 | * | 7/2003 | Keegan | 700/21 |

FOREIGN PATENT DOCUMENTS

| | | |
|---|---|---|
| DE | 198 45 135 | 1/1998 |
| JP | 09 298020 | 11/1997 |

* cited by examiner

*Primary Examiner*—Gregory J. Toatley, Jr.
*Assistant Examiner*—Roberto J. Rios
(74) *Attorney, Agent, or Firm*—Brooks Kushman P.C.

(57) ABSTRACT

An electric circuit for a vehicle electrical system powered by a voltage supply. The circuit includes a control stage having a switching device, a switching module, a signal output, and a connecting line connecting the signal output to the electrical system. The switching device includes a switching element switchable between two switching states for generating respective switching state output signals at the signal output to switch the electrical system between functional states. The switching module includes a non-volatile flip-flop formed by EEPROM cells which are operable for storing the switching state. The switching module maintains the switching state output signal to maintain the functional state of the electrical system until the switching element is switched to a different switching state, and maintains the switching state output signal to maintain the functional state of the electrical system during a voltage supply interruption.

16 Claims, 2 Drawing Sheets

ELECTRIC CIRCUIT

CROSS-REFERENCE TO RELATED APPLICATIONS

This is a continuation of International Application PCT/EP00/07649, published in German, with an international filing date of Aug. 8, 2000.

BACKGROUND OF THE INVENTION

1. Field of the Invention

The present invention relates to an electric circuit having an electronic function memory for maintaining the functional state of an electrical system of a motor vehicle during a power failure or interruption.

2. Background Art

These types of circuit arrangements are provided in order to permanently maintain an electrical system provided with two different function states. Thus, for example, it is possible in that the system is directly allocated to a power switch device. The power switch device includes a latching position which can be reached from a neutral position in order to realize one of each of two respective function states.

In the course of further development, the power-transmitting and consequently also the switching devices are replaced by push-button operated—only control currents conducting—switching devices, such as silicon switching mats, which, for example, are then allocated to bi-stable power switching relays. Embodiments of this type, however, require quite a considerable expenditure, both in terms of material and related space.

Further, it is known that, apart from these electromechanical solutions, an electronic storage operation of the respective function state must be effected. For this, a prior art specific bi-stable flip-flop may be used for storing a digital state. The flip-flop can be realized by varying technologies, such as CMOS. Such developed electronic function memories have a common characteristic in that the stored state is lost as soon as the supply of voltage of the circuit arrangement is no longer supplied. Providing an emergency power supply in the form of a storage battery or a high-capacity capacitor involves increased expenditure and only offers conditional long-term stability.

Further, for example, it is known from U.S. Pat. No. 4,388,704 to provide a bi-stable flip-flop with a device by means of which the current digital state of the flip-flop is maintained even if the supply voltage is interrupted. This type of embodiment, however, is not suitable for electrical systems installed in motor vehicles, which are operated by push-button switching devices.

Further, it is known from RELAIS LEXIKON, 2nd edition, Dr. Alfred Hüthig Verlag, Heidelberg 1985, pp. 62 and 226–242, to combine switching modules with integrated circuits, which are considered as control stages, so that a multitude of switching tasks in connection with a power switching stage can be realized by simple means. This also includes a circuit arrangement with a conventional flip-flop, which is influenced by pulse-shaped signals. The pulse-shaped signals may also be generated by push-buttons.

Further, Halbleiter-Schaltungstechnik [Semiconductor Circuit Technology], by Tietze, Schenk et al., Springer Verlag 1999, pp. 751–752, describes electrically erasable read-only memories, i.e., EEPROMs.

In addition, an electrical circuit arrangement with switching devices for initiating various functions is known from DE 198 45 135 A1, in which a control stage existing therein is a memory module developed as an EEPROM. An allocation table is stored in the memory module which allocates to each individual switching device functions which are to be influenced by the respective switching device and/or by the control stage out of a number of functions.

Finally, from JP 09 298020 A, an electrical circuit device is known for controlling a water preparation system. The electrical circuit device includes several control stages in which a key operated switching element having a switching device is allocated to each control stage. The switching state of each control stage is stored by a flip-flop formed of a EEPROM cell in a respective integrated switching module. With this embodiment, however, each control stage is provided with a microcomputer and is connected via two signal outputs and a two-wire data bus line with the electronic system. This represents a considerable expenditure.

From the above-mentioned background art there is indeed no indication in the synopsis of existing circumstances to develop and design a non-volatile flip-flop from a few EEPROM cells, i.e., to integrate the flip-flop in the control stage so that the pertinent system alone is to be influenced via a signal output of the control stage and, thus, via merely one electrical connecting line.

SUMMARY OF THE INVENTION

In view of the foregoing, it is an object of the present invention to provide an electric circuit arrangement having an electronic function memory, which is suitable for motor vehicle electrical systems, in which in the case of external and internal power failures or interruptions the previously existing function state is maintained for almost any period of time. With this type of design of an electric circuit arrangement, it is advantageous that the system can be realized with relatively simple means, in which the means only have minimal space requirements, as only one electrical connecting line is needed to connect the signal output of the control stage to the motor vehicle electrical system.

In carrying out the above object and other objects, the present invention provides an electric circuit for an electrical system in a motor vehicle. The electrical system is powered by a voltage supply and has two functional states. The electric circuit includes a control stage having a switching device, an electronic switching module, a single signal output, and a single connecting line connecting the signal output to the electrical system.

The switching device includes at least one manually operated push-button switching element switchable between two switching states for generating respective switching state output signals at the signal output in order to switch the electrical system between the two functional states. The electronic switching module includes a non-volatile flip-flop formed by EEPROM cells which are operable for storing the switching state of the switching element. The electronic switching module maintains the switching state output signal corresponding to the stored switching state at the signal output to maintain the functional state of the electrical system until the switching element is switched to a different switching state. The electronic switching module maintains the switching state output signal corresponding to the stored switching state at the signal output to maintain the functional state of the electrical system during an interruption of power from the voltage supply to the electrical system.

The flip-flop preferably includes an odd number of EEPROM cells, such as three EEPROM cells. The electronic switching module may further include an evaluation stage operable for scanning respective states of the EEPROM cells of the flip-flop. The evaluation stage includes a test component and a control logic. The control logic includes a probability component. The test component is operable for checking the respective states of the EEPROM cells and influences the control logic if the respective states of the EEPROM cells are identical. The probability component exercises a corresponding influence if the respective states of the EEPROM cells are not identical.

The at least one manually operated push-button switching element may include two manually operated push-button switching elements switchable between two switching states for generating respective switching state output signals at the signal output in order to switch the electrical system between the two functional states. The electronic switching module includes first and second inputs which are connected to the voltage supply. The two switching elements are connected between respective inputs of the electronic switching module and the voltage supply such that operation of the first switching element causes the switching state output signal "0" at the signal output and operation of the second switching element causes the switching state output signal "1" at the signal output. The electronic switching module may further include a pair of light-emitting diodes each inserted respectively between the first and second inputs of the electronic switching module and the voltage supply in series with the respective switching elements. The light-emitting diodes emit light when their respective switching element is operated. The two light-emitting diodes emit different colored light such as red and green light.

A positive pole of the voltage supply is connected to an external voltage input of the electronic switching module via a limiting resistor which limits the transformed dissipation loss in the case of over-voltage. An external supply input of the electronic switching module is connected to an internal supply input via an integrated diode which provides polarity reversal protection. A support capacitor is connected between the internal supply input and a grounded terminal of the electronic switching module to stabilize the voltage supplied by the voltage supply to the electronic switching module.

BRIEF DESCRIPTION OF THE DRAWINGS

Additional particularly advantageous embodiments of the present invention will be explained using the embodiment example shown in the drawings.

DETAILED DESCRIPTION OF THE PREFERRED EMBODIMENT(S)

Figure 1:
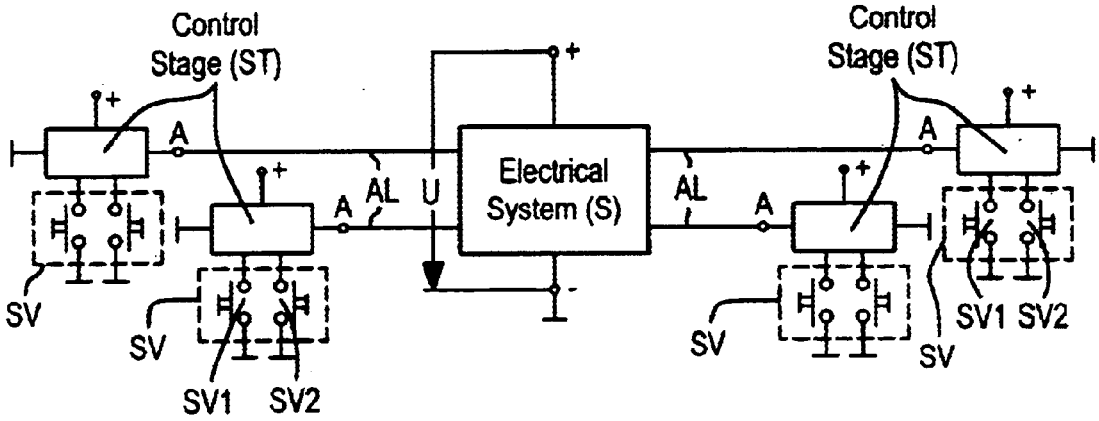
FIG. 1 illustrates an electrical circuit arrangement in accordance with the present invention having four control stages.
Figure 2:
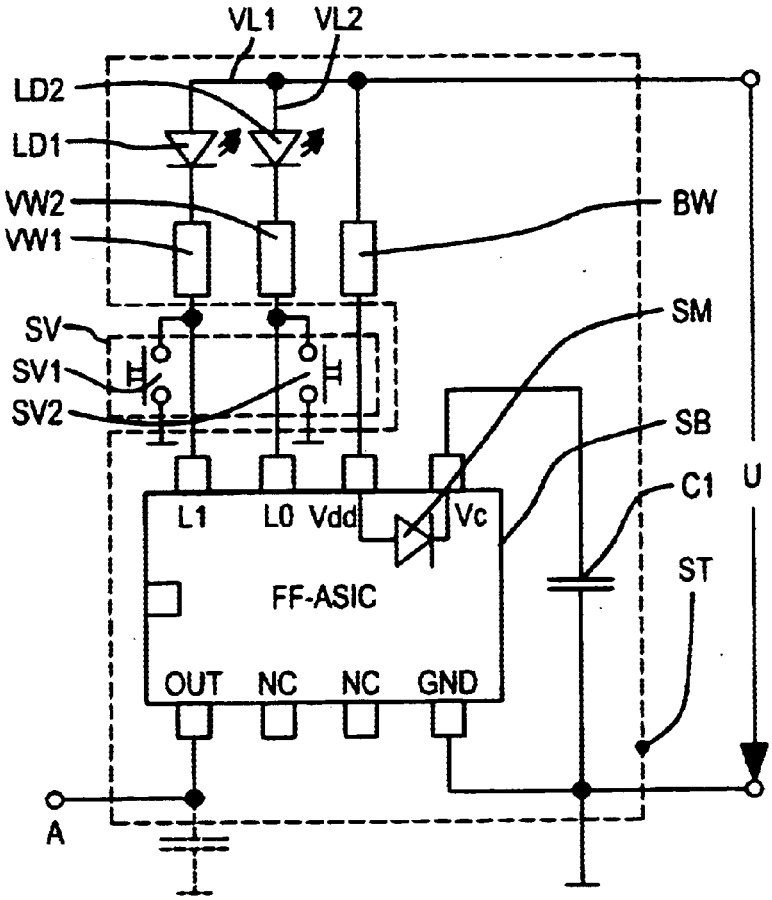
FIG. 2 illustrates one of the control stages of the electrical circuit arrangement shown in FIG. 1 with an appropriate switching device.
Figure 3:
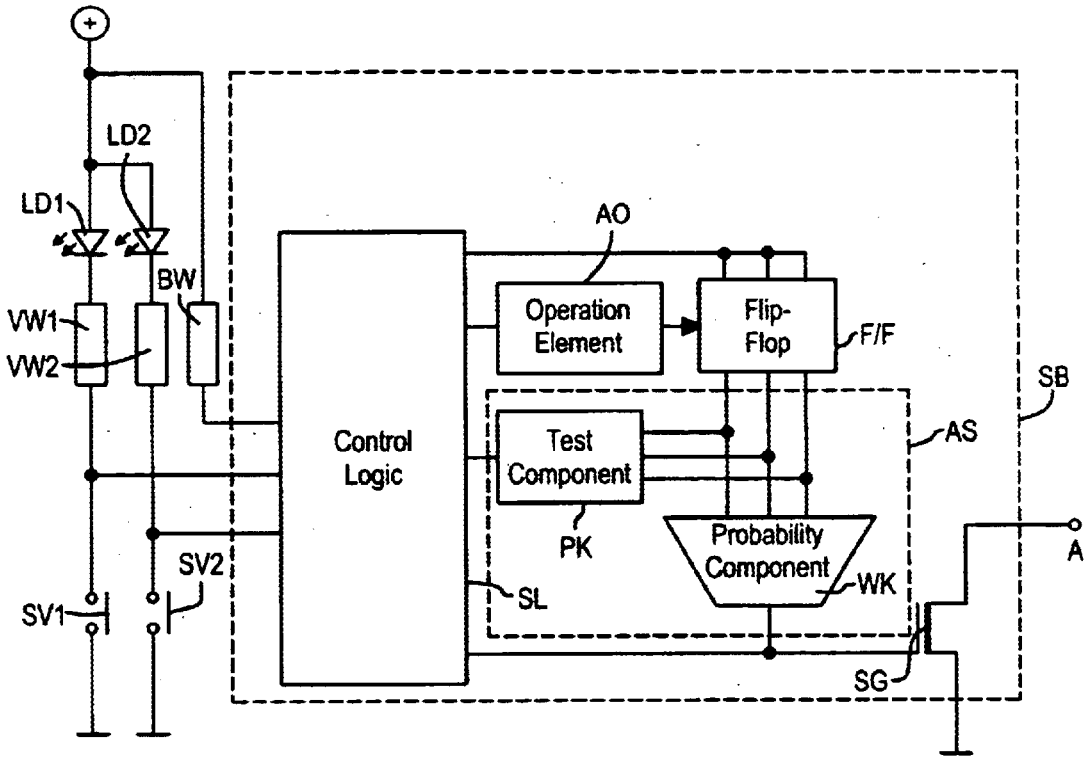
FIG. 3 illustrates the switching module of a control stage.

Referring now to FIGS. 1–3, four control stages ST of an electrical circuit arrangement in accordance with the present invention are simultaneously connected via a connecting line AL with its signal output A, which line is also connected to the voltage supply U of an electrical system S existing in a motor vehicle. For example, the electrical system S of the motor vehicle is a window or sliding roof adjusting device. Each control stage ST in turn includes a switching device SV. Each switching device SV includes two separated push-button operated switching elements SV1, SV2. Switching elements SV1, SV2 are operable to switch the electrical system S between two function states, e.g., on and off. Of course, according to this basic principle, instead of two switching elements, only a single switching element may be used. In this case, by repeatedly operating the single switching element the change-over between the two function states can be realized.

In order to ensure that such a functional state is permanent, each control stage ST is provided with an electronic switching module SB. The electronic switching module SB includes a flip-flop F/F. The flip-flop is advanced by the application of EEPROM technology to a non-volatile configuration. Preferably, the flip-flop is formed of an odd number of EEPROM cells and, most preferably, the flip-formed is formed of three EEPROM cells.

The bi-stable electronic switching module SB is used in proven process technology with a housing of which the input Vdd via a limiting resistor BW is applied to the supply voltage U so that in the case of over-voltage the transformed dissipation loss can be limited. This operating voltage is conducted via internal switching means SM to an internal supply input Vc, which is connected to a support capacitor C1 and is connected both to the ground terminal GND and directly connected to ground. The support capacitor C1 provides short-term stabilization of the working voltage. The output OUT of the electronic switching module SM is then conducted to the signal output terminal A of the control stage ST.

The two terminals L1, L0, which generally are referred to as SET and RESET, are jointly connected at the positive pole (+) of the voltage supply U via series resistors VW1, VW2. The series resistors VW1, VW2 are located in the connecting lines VL1, VL2, of the terminals. Light emitting diodes (LEDs) LD1, LD2 are allocated to the resistors. Of the LEDs operating in the visible wave spectrum, preferably one LED such as LD1 emits red light and the other LED such as LD2 emits green light.

The switching device SV with the two push-button operated switching elements SV1, SV2 is connected to the two inputs L1, L0 of the switching module SB or at the connecting lines VL1, VL2, which are allocated to the inputs. By operating the switching element SV1 the status "1" is generated at the output A of the switching module SB, while when operating the switching element SV2 the status "0" is generated at the output A. The respective status is then displayed by the pertinent light-emitting diode.

In order to obtain the function status which exists at the signal output A and, therefore, is pertinent to the allocated system section, until a switchover occurs as a result of a new operation of the switching device SV, —as follows from FIG. 3—the electronic module SB, which is designed as an application specific integrated circuit (ASIC), is provided with the non-volatile flip-flop F/F. Advantageously, the non-volatile flip-flop F/F is formed by three EEPROM cells. An operation element AO transforms these three EEPROM cells respectively into one of the potential states by means of a control logic SL which is connected to the switching elements SV1, SV2. One of the three EEPROM cells inserted after the evaluation stage AS records via a test component PK whether all cells unanimously are in the same state. If this is the case, the signal output A is applied via the control logic SL to the designated signal potential by means of a corresponding influence of an allocated electronic switching element SG.

Further, a probability component WK is allocated to the EEPROM cells by means of which a majority decision is made. This is relevant, if a failure has occurred in the course of a status change in the EEPROM cells, in which case, the status adopted by the majority of cells, i.e., of two cells, is considered to be correct. At the same time, the probability component WK directly influences the switching element SG allocated to the signal output A.

While embodiments of the present invention have been illustrated and described, it is not intended that these embodiments illustrate and describe all possible forms of the present invention. Rather, the words used in the specification are words of description rather than limitation, and it is understood that various changes may be made without departing from the spirit and scope of the present invention.

What is claimed is:

1. An electric circuit for an electrical system in a motor vehicle, the electrical system being powered by a voltage supply and having two functional states, the electric circuit comprising:

at least one control stage including a switching device, an electronic switching module, a single signal output, and a single connecting line connecting the signal output to the electrical system;

the switching device including at least one manually operated push-button switching element switchable between two switching states for generating respective switching state output signals at the signal output in order to switch the electrical system between the two functional states;

the electronic switching module including a non-volatile flip-flop formed by EEPROM cells which are operable for storing the switching state of the switching element, wherein the electronic switching module maintains the switching state output signal corresponding to the stored switching state at the signal output to maintain the functional state of the electrical system until the switching element is switched to the other switching state, and maintains the switching state output signal corresponding to the stored switching state at the signal output to maintain the functional state of the electrical system during an interruption of power from the voltage supply to the electrical system;

the electronic switching module further includes an evaluation stage operable for scanning respective states of the EEPROM cells of the flip-flop;

wherein the evaluation stage includes a test component and a control logic, the control logic including a probability component, wherein the test component is operable for checking the respective states of the EEPROM cells and correspondingly influences the control logic if the respective states of the EEPROM cells are identical, wherein the probability component exercises an influence corresponding to the majority of states if the respective states of the EEPROM cells are not identical.

2. The electric circuit of claim 1 wherein:

the flip-flop includes an odd number of EEPROM cells.

3. The electric circuit of claim 2 wherein:

the flip-flop includes three EEPROM cells.

4. The electric circuit of claim 1 wherein:

the at least one manually operated push-button switching element includes two manually operated push-button switching elements switchable between two switching states for generating respective switching state output signals at the signal output in order to switch the electrical system between the two functional states.

5. The electric circuit of claim 4, wherein:

the electronic switching module includes first and second inputs which are connected to the voltage supply, wherein the two switching elements are connected between respective inputs of the electronic switching module and the voltage supply such that operation of the first switching element causes the switching state output signal to be "0" at the signal output and operation of the second switching element causes the switching state output signal to be "1" at the signal output.

6. The electric circuit of claim 5, wherein:

the electronic switching module further includes a pair of light-emitting diodes each inserted respectively between the first and second inputs of the electronic switching module and the voltage supply in series with the respective switching elements, wherein the light-emitting diodes emit light when their respective switching element is operated.

7. The electric circuit of claim 6 wherein:

the two light-emitting diodes emit different colored light.

8. The electric circuit of claim 7 wherein:

one of the two light-emitting diodes emits red light and the other of the two light-emitting diodes emits green light.

9. The electric circuit of claim 1 wherein:

a positive pole of the voltage supply is connected to an external voltage input of the electronic switching module via a limiting resistor which limits the transformed dissipation loss in the case of over-voltage.

10. The electric circuit of claim 1 wherein:

an external supply input of the electronic switching module is connected to an internal supply input via an integrated diode which serves as polarity reversal protection.

11. The electric circuit of claim 10 wherein:

a support capacitor connected between the internal supply input and a grounded terminal of the electronic switching module to stabilize the voltage supplied by the voltage supply to the electronic switching module.

12. An electric circuit for an electrical system in a motor vehicle, the electrical system being powered by a voltage supply and having two functional states, the electric circuit comprising:

at least one control stage including a switching device, an electronic switching module, a single signal output, and a single connecting line connecting the signal output to the electrical system;

the switching device including two manually operated push-button switching elements switchable between two switching states for generating respective switching state output signals at the signal output in order to switch the electrical system between the two functional states;

the electronic switching module including a non-volatile flip-flop formed by EEPROM cells which are operable for storing the switching state of the switching element, wherein the electronic switching module maintains the switching state output signal corresponding to the stored switching state at the signal output to maintain the functional state of the electrical system until the switching elements are switched to the other switching state, and maintains the switching state output signal corresponding to the stored switching state at the signal output to maintain the functional state of the electrical system during an interruption of power from the voltage supply to the electrical system;

the electronic switching module further includes an evaluation stage operable for scanning respective states of the EEPROM cells of the flip-flop;

wherein the evaluation stage includes a test component and a control logic, the control logic including a probability component, wherein the test component is operable for checking the respective states of the EEPROM cells and correspondingly influences the control logic if the respective states of the EEPROM cells are identical, wherein the probability component exercises an influence corresponding to the majority of states if the respective states of the EEPROM cells are not identical.

13. An electric circuit for an electrical system in a motor vehicle and powered by a voltage supply, the electric circuit comprising:

at least one control stage including a switching device, an electronic switching module, a single signal output, and a single connecting line connecting the signal output to the electrical system for switching an appertaining part of the electrical system in one of two functional states;

the switching device including at least one manually operated push-button switching element switchable between two switching states for generating respective switching state output signals at the signal output in order to switch the appertaining part of the electrical system between the two functional states;

the electronic switching module including a non-volatile flip-flop formed by EEPROM cells which are operable for storing the switching state of the switching element, wherein the electronic switching module maintains the switching state of the output signal corresponding to the stored switching state at the signal output to maintain the functional state of the appertaining part of the electrical system until the switching element is switched to the other switching state, and maintains the switching state of the output signal corresponding to the stored switching state at the signal output to maintain the functional state of the appertaining part of the electrical system during an interruption of power from the voltage supply to the electrical system;

the electronic switching module further includes an evaluation stage operable for scanning respective states of the EEPROM cells of the flip-flop;

the evaluation stage includes a test component and a control logic, the control logic including a probability component, wherein the test component is operable for checking the respective states of the EEPROM cells and correspondingly influences the control logic if the respective states of the EEPROM cells are identical, wherein the probability component exercises an influence corresponding to the majority of states if the respective states of the EEPROM cells are not identical.

14. The electric circuit of claim 13 wherein:

the at least one manually operated push-button switching element includes two manually operated push-button switching elements switchable between two switching states for generating respective switching state output signals at the signal output in order to switch the appertaining part of the electrical system between the two functional states.

15. The electric circuit of claim 14 herein:

the flip-flop includes an odd number of EEPROM cells.

16. The electric circuit of claim 15, wherein:

the flip-flop includes three EEPROM cells.

* * * * *